United States Patent [19]

Erismann et al.

[11] 4,100,649

[45] Jul. 18, 1978

[54] METHOD AND APPARATUS FOR PRODUCING A UNIFORM TEXTILE FIBER SLIVER

[75] Inventors: Hans Erismann, Fislisbach; Werner Graf, Freienbach, both of Switzerland

[73] Assignee: Graf & Cie. A.-G., Rapperswil, Switzerland

[21] Appl. No.: 725,245

[22] Filed: Sep. 21, 1976

[30] Foreign Application Priority Data

Oct. 1, 1975 [DE] Fed. Rep. of Germany ..... 2543839

[51] Int. Cl.[2] ..... D01G 31/00; D01H 5/32

[52] U.S. Cl. ..... 19/0.2; 19/240

[58] Field of Search ..... 19/239–241, 19/0.2, 0.23; 226/29, 42, 44

[56] References Cited

U.S. PATENT DOCUMENTS

| | | | |
|---|---|---|---|
| 1,986,724 | 1/1935 | Goins | 226/42 |
| 2,147,421 | 2/1939 | Bendz | 226/42 |
| 3,012,288 | 12/1961 | Werner | 19/240 |
| 3,184,798 | 5/1965 | Burnet et al. | 19/240 X |
| 3,703,023 | 11/1972 | Krauss et al. | 19/240 |
| 3,862,473 | 1/1975 | Felix et al. | 19/240 |
| 3,890,547 | 6/1975 | Keck | 226/42 X |

FOREIGN PATENT DOCUMENTS

| | | | |
|---|---|---|---|
| 2,124 | 5/1962 | Japan | 19/239 |
| 866,286 | 4/1961 | United Kingdom | 226/42 |

*Primary Examiner*—Dorsey Newton

*Attorney, Agent, or Firm*—Lane, Aitken, Dunner & Ziems

[57] ABSTRACT

An apparatus for producing a uniform textile fiber sliver which is removed from a sliver supply device, for instance a card, and taken-up by a driven take-up or receiving device, wherein the fiber sliver removed from the sliver supply device is guided through a regulation drafting arrangement having a pair of measuring rolls and a driven pair of drafting rolls. One roll of the measuring roll pair is driven by the sliver supply device, and the other measuring roll is deflected as a function of a change in thickness of the fiber sliver traveling through the measuring rolls. The drive speed of the pair of drafting rolls and the receiving or take-up device is regulated as a function of the deflection of said other measuring roll, and the drive speed of the take-up device additionally is regulated as a function of the length of the fiber band between the pair of drafting rolls and the take-up device. The drive speed of the take-up device additionally is regulated as a function of the drive speed of the sliver supply device and the measuring roll driven thereby. The fiber sliver is guided between the pair of drafting rolls and the take-up device in the form of a loop, and the through-hang of the fiber sliver-loop is continuously changed between a maximum value and a minimum value whenever the minimum through-hang is reached, the drive speed of the take-up device is decreased for such length of time until the through-hang has reached the maximum value, whereafter the drive speed of the take-up device is increased for such length of time until the through-hang again has reached its minimum value.

14 Claims, 8 Drawing Figures

METHOD AND APPARATUS FOR PRODUCING A UNIFORM TEXTILE FIBER SLIVER

BACKGROUND OF THE INVENTION

The present invention relates to a new and improved method of, and apparatus for, producing a uniform textile fiber sliver or the like which is taken-off from a sliver supply device, for instance a carding machine, and taken-up by a driven take-up or receiver device.

The equipment of the present invention is of the type wherein the fiber sliver removed from the sliver supply device is guided through a regulation drafting arrangement possessing a pair of measuring rolls and a driven pair of drafting rolls, one measuring roll of the measuring roll pair being driven by the sliver supply device and the other measuring roll being deflected as a function of a change in thickness in the fiber sliver traveling through the measuring rolls. Further, the drive speed of the pair of drafting rolls and the take-up device are regulated as a function of a deflection of said other measuring roll, and the drive speed of the take-up device is additionally regulated as a function of the length of the fiber sliver between the pair of drafting rolls and the take-up device.

Such type equipment has been disclosed for instance in Swiss Pat. No. 505,221. With this apparatus difficulties nonetheless can arise. Changes in the speed of the carding machine are only here incompletely compensated, because only a possible effect upon the thickness of the fiber sliver after detection by means of deflection of the one measuring roll produces a corresponding change in the drive speed of the pair of drafting rolls and the take-up device. At higher operating speeds, such regulation operates much too sluggishly. A further difficulty resides in the fact that with the heretofore known apparatus there is provided between the pair of drafting rolls and the take-up device only a fiber band-intermediate storage having an indicator for indicating the degree of filling. In this case, there are formed numerous superimposed loops of the fiber sliver. Only after complete emptying or overfilling of the fiber sliver-intermediate storage are there delivered appropriate control commands to the drive devices. At high operating speeds a fiber sliver-intermediate storage, which receives a multiplicity of superimposed fiber sliver loops, oftentimes is the cause of disturbances.

Further, there is known a similar type of apparatus from U.S. Pat. No. 3,862,473 wherein equally there is provided a regulation device for the drive speed. However, here the sliver supply device, a first pair of rolls and the take-up device are rigidly drivingly interconnected with one another. A separate drive is only provided for the pair of drafting rolls. The regulation device likewise is controlled as a function of the thickness of the fiber sliver. Owing to the common control of all drive elements, which are rigidly interconnected in driving relationship with one another, there is however only possible a special control with respect to the drafting rolls, not however also an independent control of the not even present different drives for accommodation of the individual elements to one another. High operating speeds are then only possible if there are tolerated frequent disturbances. The known apparatus furthermore possesses a fiber sliver-intermediate storage which, if desired, produces by means of two light barriers an additional influencing of the regulation device. The one light barrier merely determines that fiber sliver has been deposited into the fiber sliver-intermediate storage. The other light barrier responds when the fiber sliver-intermediate storage is empty and the remaining fiber sliver loop, during its increasing shortening in length, has been pulled past the light barrier. This only then occurs if a large tension is present in the fiber sliver. Under normal operating conditions there should not arise any response of the second light barrier.

SUMMARY OF THE INVENTION

Hence, it is a primary object of the present invention to provide a new and improved method of, and apparatus for, producing a uniform textile fiber sliver which avoid the aforementioned drawbacks and limitations of the prior art proposals.

Another and more specific object of the present invention contemplates, starting for instance from a prior art solution as known for instance from Swiss Pat. No. 505,221, producing a fiber sliver of uniform thickness in a reliable manner and at high operating speeds.

Now in order to implement these and still further objects of the invention, which will become more readily apparent as the description proceeds, the previously mentioned method of the invention is manifested by the features that the drive speed of the take-up device is additionally regulated as a function of the drive speed of the sliver supply device and the measuring roll driven thereby, that the fiber sliver is guided in a loop between the pair of drafting rolls and the take-up device and the through-hang of the fiber sliver loop is continuously altered between a maximum value and a minimum value in that in each instance upon reaching the minimum through-hang the drive speed of the take-up device is reduced for such length of time until the through-hang has reached the maximum value, whereupon in each case the drive speed of the take-up device is increased for such length of time until the through-hang again has reached its minimum value.

Not only is the invention concerned with the aforementioned method aspects but also relates to apparatus for the performance of such method which is manifested by the features that there is connected with the regulation device a measurement value receiver which produces signals proportional to the drive speed of the sliver supply device and the measuring roll driven thereby, these signals being processed by the regulation device for regulating the drive speed of the pair of drafting rolls and the take-up device. Further, a monitoring device for monitoring the through-hang of a fiber sliver loop is connected at the regulation device between the pair of drafting rolls and the take-up device. The monitoring device comprises an upper trigger location responsive to the minimum through-hang and a lower trigger location responsive to the maximum through-hang, wherein whenever there is a response of the upper trigger location the drive speed of the take-up device is reduced for such length of time until the lower trigger location responds, whereupon in each instance the drive speed of the take-up device is increased for such length of time until the upper trigger location again responds.

There will be firstly recognized that in this case the regulation device has supplied thereto, apart from the control as a function of the deflection of the one measuring roll, an additional guide magnitude, specifically in the form of a signal derived from the drive speed of the sliver supply device. The control signal delivered by the regulation device can be utilized for regulating the drive speed of the pair of drafting rolls as well as for regulating the drive speed of the take-up device. Since now the regulation device no longer only responds to the thickness of the fiber sliver, but also to the drive speed of the sliver supply device, there is possible a much more sensitive accommodation to the prevailing operating conditions. The regulation device responds much more quickly. The entire apparatus therefore also can operate with the same reliability as heretofore even at increased operating speeds. Additionally, between the pair of drafting rolls and the take-up device there is controlled the position of a single fiber band loop, which can be used directly, or by means of the regulation device, for controlling the drive speed of the take-up device. In addition to the fundamental adjustment of the drive speeds to the fiber sliver thickness and the drive speed of the sliver supply device, there is carried out in this case an augmenting accommodation of the drive speed of the take-up device to the momentary position of the fiber band loop along its path from the drafting rolls to the take-up device. Even at high drive speeds it is therefore not necessary to fear the previously arising difficulties when working in this speed range. In practice, there is used for the regulation device a computer which through the agency of speed regulators controls the independent drive motors of the pair of drafting rolls and the take-up device. In order to influence the drive speed of the take-up device, the monitoring device thus can act via the computer or directly upon the speed regulator of the drive motor of the take-up device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
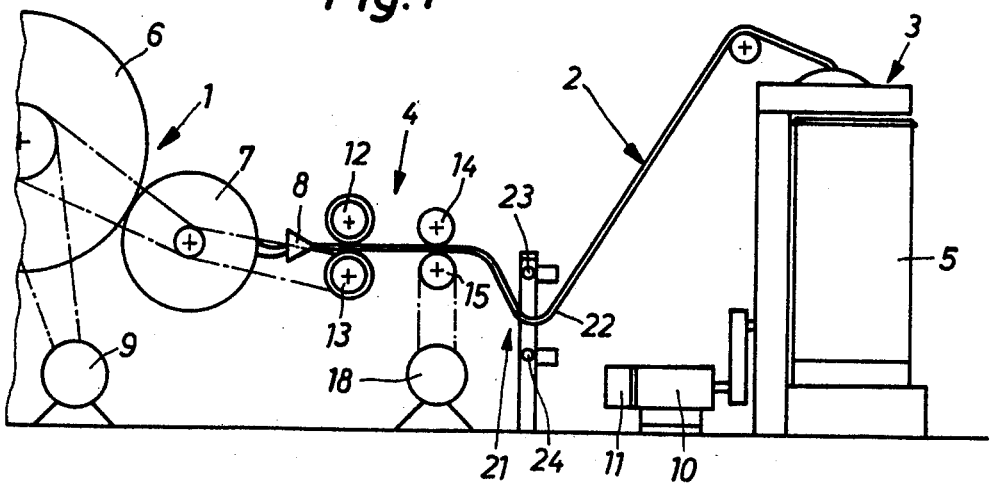
FIG. 1 is a side view of an exemplary embodiment of apparatus for producing a uniform textile fiber sliver or the like and useful in the performance of the method.
Figure 2:
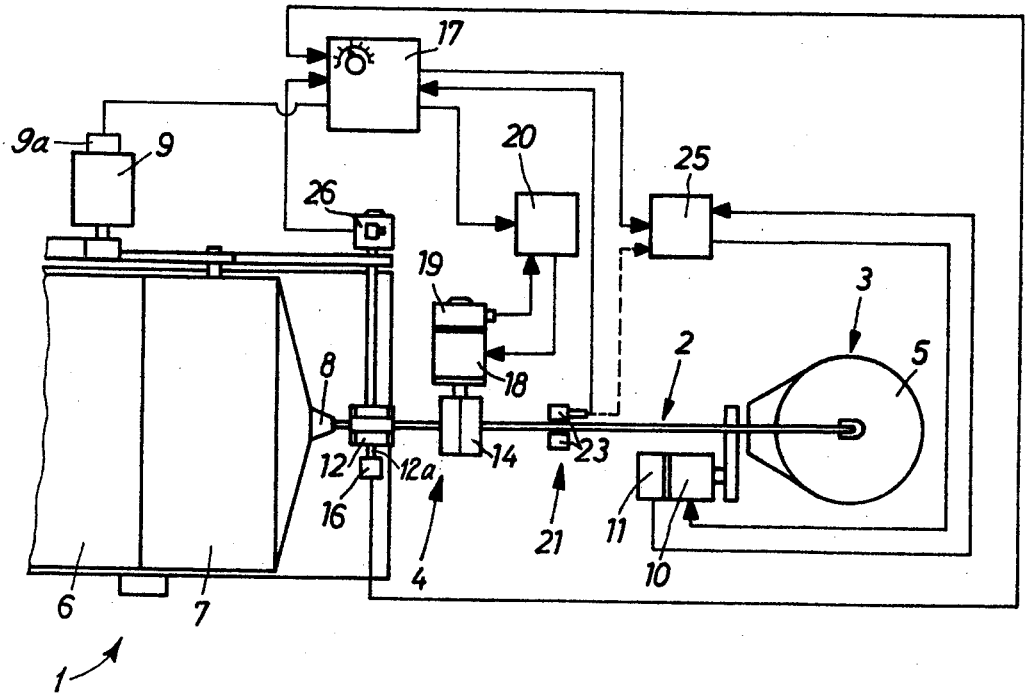
FIG. 2 is a top plan view of the apparatus of FIG. 1.

Describing now the drawings, and as will be seen from FIGS. 1 and 2, a regulation or regulator drafting arrangement 4 is arranged between a sliver supply device 1, from which there is removed a fiber sliver 2 or the like, and a fiber sliver take-up device 3. In the exemplary embodiment under discussion, the sliver supply device 1 is a card or carding machine and the fiber sliver take-up device 3 is a sliver can 5.

As to the card or carding machine 1 only the most important components have been illustrated, namely the main cylinder or drum 6, the take-off roll 7, the sliver funnel 8 and the drive motor 9 which, for instance, can be constituted by an electric motor. The sliver can or can arrangement 5 can be driven by means of a speed-regulated electric motor 10, preferably a direct-current motor, and with which there is operatively connected a tachogenerator 11.

Figure 3A:
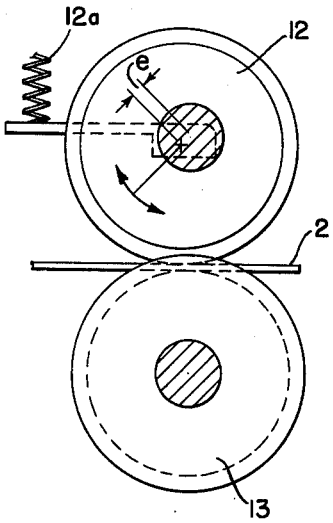
FIGS. 3*a* and 3*b* are a side view and a cross-sectional view, respectively, of the grooved rolls forming a part of the apparatus of FIG. 1.
Figure 3B:
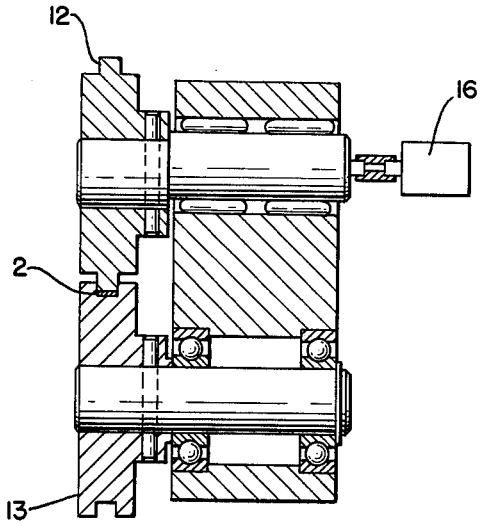

The regulation drafting arrangement 4 possesses a pair of measuring rolls 12, 13 constructed as grooved rolls which can be any type known in the art, such as illustrated in FIG. 3, and a pair of drafting rolls 14, 15. The lower, stationary measuring roll 13 is driven through the agency of a gearing transmission or a slip-free belt by the card drive 9. The upper measuring roll 12 is eccentrically mounted, biased by a spring 12*a*, and is deflected as a function of the thickness variations of the fiber sliver 2 traveling between the measuring rolls 12, 13. This deflection of the measuring roll 12 causes a rotation of a control shaft 12*b*. This rotation is transformed into an electrical signal in a measuring value receiver 16, this signal being delivered as an input magnitude to a still to be described computer 17 of a regulation device or regulator.

The pair of drafting rolls 14, 15, the lower roll 15 of which for instance is formed as a grooved roll and the upper roll 14 of which can be constructed as a rubber roll, is driven by a speed-regulated electric motor 18, preferably a direct-current motor. In the embodiment under discussion both of the rolls 14 and 15 are synchronously driven.

The electric motor 18 is coupled with a tachogenerator 19 delivering to a speed regulator 20 a signal which is proportional to the drive rotational speed of the drafting rolls 14, 15. This speed regulator 20 is connected with the computer 17 and serves to regulate the rotational speed of the electric motor 18.

Between the pair of drafting rolls 14, 15 and the can arrangement or can 5 there is located a monitoring device 21 through which there is guided the sliver 2 in a loop 22. The monitoring device 21 comprises an upper light barrier 23 defining a trigger location and a lower light barrier 24 equally defining a trigger location. Both of these light barriers 23, 24 are connected with the computer 17 or with the speed regulator 25 and always then respond when the sliver loop 22 possesses its minimum and maximum through-hang respectively. Response of the upper light barrier 23 causes, in a manner still to be described, reduction of the drive speed of the can arrangement 5, whereas response of the lower light barrier 24 causes an increase of the drive speed of the can arrangement 5.

Figure 4:
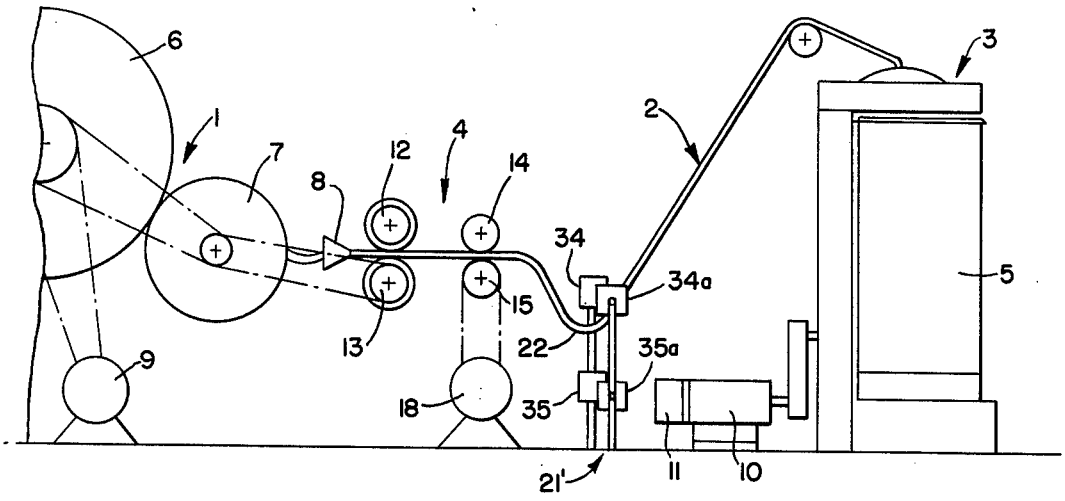
FIG. 4 is a side view of an alternate embodiment of the apparatus shown in FIG. 1.
Figure 5:
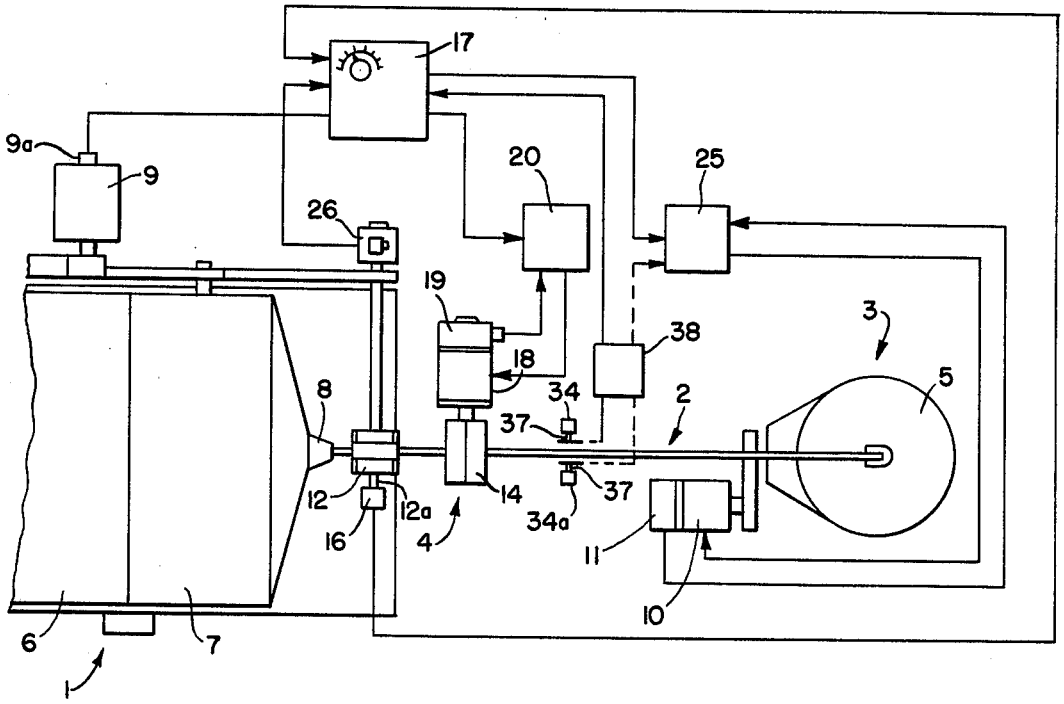
FIG. 5 is a top plan view of the apparatus of FIG. 4.

Attainment of the maximum and minimum through-hang of the loop 22 can also be detected in a manner different than with the aid of light barriers, for instance capacitively or by means of terminal switches. Monitoring of the maximum and minimum through-hang of the loop 22 by capacitive means is achieved by the substitution of capacitive elements, such as those commercially available from G. Manta Ingenieur Dumaco AG, for the upper and lower light barriers 23 and 24, respectively, as schematically shown in FIGS. 4 and 5. The monitoring device 21' includes an upper pair of oppositely-disposed, parallel plates 34 and 34*a*, and a lower pair of oppositely-disposed, parallel plates 35 and 35*a*, with the plates 34 and 35 vertically spaced on a support 36 and the plates 34*a* and 35*a* similarly fixed to a support 36*a*. Each pair of plates, 34, 34*a* and 35, 35*a*, are electrically isolated from the supports 36, 36*a*, such as by isolating elements 37, to form a capacitor of a specific, predetermined value of capacitance. The vertical position of the pairs of plates on the supports is determined by the desired length of the through-hang of sliver loop 22.

As soon as the sliver 2 passes between the plates of one of these capacitors, its capacitance is changed because of the change of the dielectric between the plates. As is known, this change in capacitance may be detected by a capacitance-measuring bridge 38 and be transformed into a signal delivered to the computer 17 or to the speed regulator 25.

Figure 6:
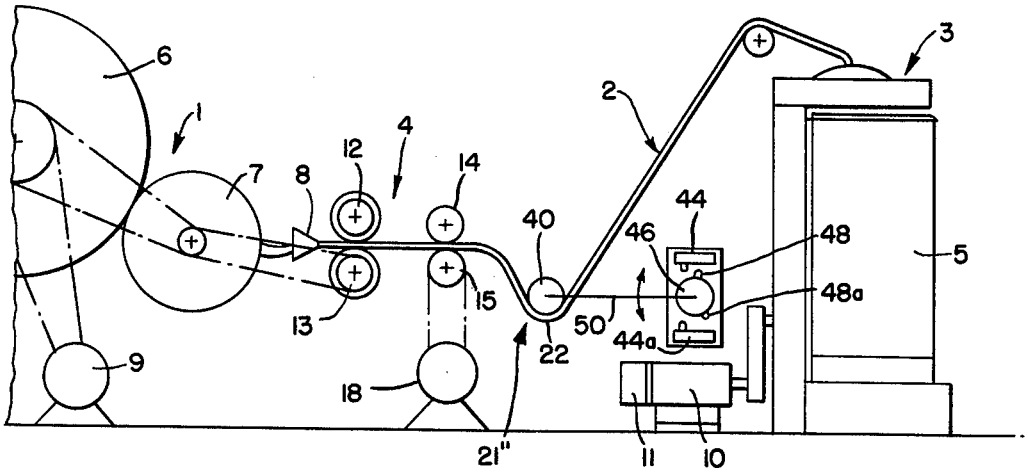
FIG. 6 is a side view of yet another alternate embodiment of the apparatus shown in FIG. 1.

Monitoring of the through-hang by activation of terminal switches is shown in the embodiment of FIG. 6. The monitoring device 21' includes a rotatable member 40 over which the sliver loop 22 is passed, with the member 40 being displaceable by adjustment of the loop. A switch mechanism 42 is disposed adjacent to the displaceable member 40, and is provided with terminal switches 44 and 44*a*, which are switched on and off by a rotatable cam 46 provided with arms or trigger elements 48 and 48*a* positioned along the periphery of the cam. A rigid connection 50 joins the member 40 with the cam 46, such that actuation of the cam is controlled by the sliver loop 22.

The tachogenerator 11 of the electric motor 10 delivers its output signals to the speed regulator 25 which is connected to the output of the computer 17 and regulates the rotational speed of the electric motor 10.

As shown in phantom lines in FIG. 2, the light barriers 23 and 24 can be directly connected with the speed regulator 25 instead of being connected with the computer 17.

The computer 17 receives as a further input magnitude the output signals of a tachogenerator 26 defining a measuring value receiver which measures the driving rotational speed of the card 1 and the measuring roll 13 driven thereby.

Figure 7:
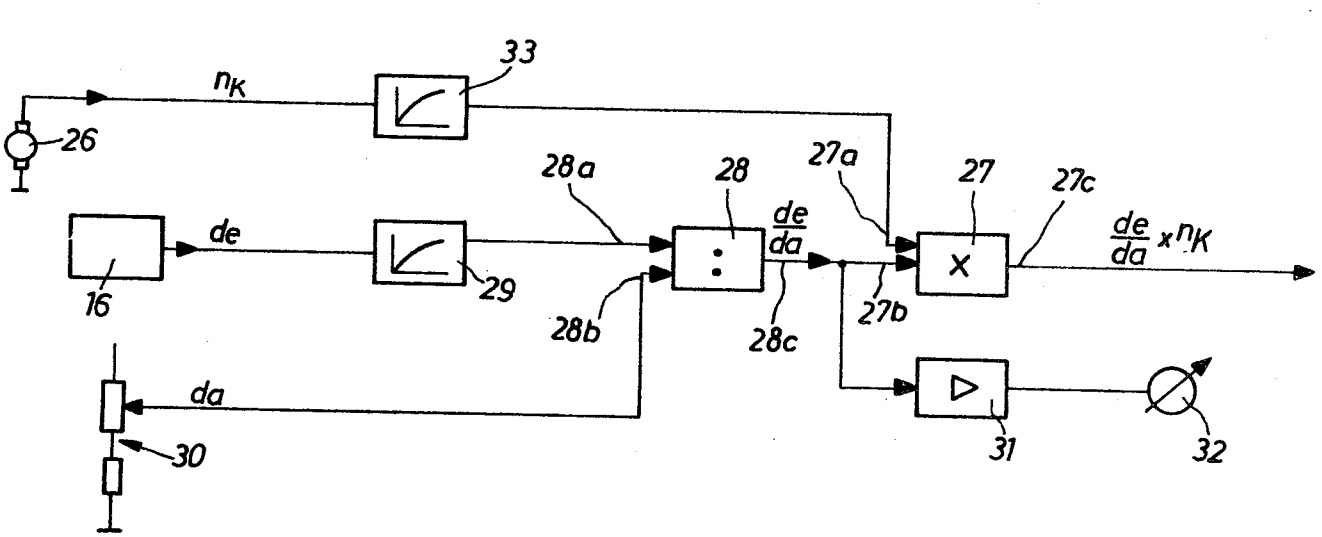
FIG. 7 is a block circuit diagram of part of the regulator device.

FIG. 7 illustrates a block circuit diagram of part of the computer 17.

The tachogenerator 26 is connected through the agency of an adjustment element 33 with the one input 27*a* of a multiplier 27. At the other input 27*b* of the multiplier 27 there is connected a divider or division circuit 28, the input side of which has delivered to the input 28*a* through the agency of the adjustment element 29 signals produced by the measurement value receiver 16. At the second input 28*b* of the divider 28 there is connected a reference value transmitter 30 for the preselected sliver thickness. This reference value transmitter 30, in the embodiment under discussion is constructed as a potentiometer. The output 28*c* of the divider 28 is connected through the agency of an amplifier 31 with an indicator device 32.

By means of the potentiometer 30 there is adjusted the desired thickness of the sliver (sliver count). From the measuring value receiver 16 there are delivered to the divider 28 the signals $d_e$ proportional to the thickness of the sliver 2 scanned at the measuring roll 12. At the output 28*c* of the divider 28 there appear the signals which are proportional to the sliver thickness, these signals in turn being delivered to the multiplier 27 and also via the amplifier 31 to the indicator device 32. By means of the indicator device or indicator 32 there is displayed the thickness of the sliver 2.

The signals generated by the tachogenerator 26, which are proportional to the rotational speed $n_K$ of the card 1, are delivered to the multiplier 27, which produces at its output 27*c* signals which are dependent upon the card rotational speed $n_K$, the measured sliver thickness $d_e$ and the reference value $d_a$ of the sliver thickness. These output signals of the multiplier 27 form the guide magnitude for the speed regulator 20 of the drafting roll-drive 18 and the guide magnitude for the speed regulator 25 of the sliver can-drive 10. These guide magnitudes for the speed regulator 25 are, however, still influenced by the monitoring device 21. In the description to follow there will be considered the function of the illustrated apparatus.

At the computer 17 there is adjusted, as described, the desired thickness of the sliver 2 (sliver count). Furthermore, there is set at the computer 17 an average drafting value which is so large that even the thinnest sliver locations, which are to be compensated or evened out, still can be compensated by the drafting arrangement 4, i.e. the drafting magnitude, even for the thinnest still to be compensated sliver location, should not fall below the value 1. Similarly, a drafting magnitude, for example, 1.5, is selected to effect the compensation of the thick locations of the sliver 2.

It is possible that the sliver 2 may have locations, or portions, with a thickness smaller than the preselected minimum thickness, or greater than the preselected maximum thickness, for the compensation of which a drafting magnitude of 1.0 and 1.5, respectively, would not be sufficient. In the computer 17 there is provided a monitoring logic circuit which, upon exceeding or falling below a drafting boundary value, for instance the drafting magnitude 1.5 and the drafting magnitude 1, responds and triggers a fault indicator signal by means of which there can be interrupted the sliver infeed into the regulation drafting arrangement 4, such as by the activation of the stop means 9*a* (FIG. 2), connected to the drive motor 9 and the computer 17, to stop the carding machine 1. The stop means 9*a* can be of any type which will stop the carding machine. Upon switching-in the apparatus this monitoring logic circuit is blocked during a preselectable time span, thus facilitating the introduction of the sliver.

The fleece removed from the take-off roll 7 and compacted into a slubbing in the sliver funnel or condenser 8, is further compacted by the pair of measuring rolls 12, 13 and simultaneously scanned as to its thickness. The deflection of the measuring roll 12, as already explained, is transformed by the measuring value receiver 16 into an electrical signal which is delivered in the form of an input magnitude to the computer 17.

As already described on the basis of the showing of FIG. 7, the computer 17 now generates an output signal which is dependent upon the sliver cross-section determined by the measuring roll 12, the reference cross-section preselected at the computer 17 and card drive speed detected by the tachogenerator 26. This output signal of the computer 17 is delivered as a guide magnitude to both of the speed regulators 20 and 25 which accordingly increase or decrease, as the case may be, the rotational speed of the electric motors 10 and 18.

In this way the draft is appropriately altered and the rotational speed of the electric motor 10 of the can arrangement 5 simultaneously changed and in the same sense as the drive speed of the pair of drafting rolls 14, 15.

Due to the electrical synchronization of the drafting arrangement, i.e. the pair of drafting rolls 14, 15 with the card or carding machine 1, i.e. the take-off roll or device 7, it is possible to stop and start the card without there occurring any rupture in the card sliver.

The drafting rolls 14 and 15 and the can arrangment 5, owing to their unequal inertia masses during parallel control of their speed regulators 20 and 25 by the computer 17, exhibit different reaction times. As a result a difference briefly exists between the conveying speed of the drafting rolls 14, 15 and the take-up speed of the can arrangement 5, so that at times there is a deficiency and at other times an excess of sliver between the pair of drafting rolls 14, 15 and the can arrangement 5.

The monitoring device 21 serves to compensate such different reaction times of the pair of drafting rolls 14, 15 and the can arrangement 5. This monitoring device 21, according to the principle of a two-point regulation, continually influences the withdrawal speed of the can 5 as a function of the through-hang of the sliver loop 22 and thus the stability of the apparatus even if there are present short-time, periodic speed fluctuations.

Further, it is of advantage if the regulation amplifier of the speed regulator 25 for the electric motor 10 can be markedly dampened in order that the mechanical part of the can arrangement 5 which is prone to large inertia masses is not exposed to any too great mechanical loads which, in the case of rapid changes in the rotational speed could arise.

The monitoring device 21 operates in the following manner: if the through-hang of the fiber sliver loop 22 has reached the maximum value, then the lower trigger location responds, i.e. the light barrier 24. Consequently, a signal is generated which either is delivered to the computer 17 or the speed regulator 25 and brings about an increase in the drive speed of the can arrangement 5 by a certain amount as a function of the guide magnitude of the speed regulator 25. The can arrangement or can 5 is driven at increased speed for such length of time until the through-hang of the fiber sliver loop 22 has reached the minimum value and the upper trigger location responds, i.e. the light barrier 23. The thus generated signal is appropriately delivered to the computer 17 or the speed regulator 25, which in turn causes the drive speed of the can arrangement 5 to again be reduced by a certain amount as a function of the guide magnitude of the speed regulator 25. The can arrangement 5 is driven for such length of time at the reduced speed until the through-hang has again reached the maximum value and the lower trigger location 24 once again responds and as described there occurs an increase in the drive speed of the can arrangement 5. This operation repeats, so that the fiber sliver loop 22, during operation of the apparatus, continuously moves between the lower trigger location 24 and the upper trigger location 23.

The speed regulation of the drive motors 10 and 18 can occur in some other suitable manner. If the electric motors 10 and 18 are designed as direct-current motors then by means of the speed regulators 20 and 25 it is possible to infinitely vary the armature voltage and thus the rotational speed. These speed regulators 20 and 25 are of conventional construction and designed as thyristor regulation devices having phase control.

While there are shown and described presently preferred embodiments of the invention, it is to be distinctly understood that the invention is not limited thereto, but may ben otherwise variously embodied and practiced within the scope of the following claims.

Accordingly, what is claimed is:

1. An apparatus for producing a uniform textile fiber sliver, comprising: a sliver supply device for delivering a fiber sliver, a take-up device for the fiber sliver, means for driving the take-up device independently of the supply device, a regulation drafting arrangement located between the supply device and the take-up device, said regulation drafting arrangement comprising a pair of measuring rolls and a pair of drafting rolls, means for independently driving said pair of drafting rolls, means for driving one of the measuring rolls of the pair of measuring rolls by means of the supply device, the other measuring roll being deflectable as a function of the change in thickness of the fiber sliver guided between the measuring rolls, regulation means for regulating the drive speed of the pair of drafting rolls and the take-up device as a function of the deflection of said other measuring roll and for the additional regulation of the drive speed of the take-up device as a function of the length of the fiber sliver between the pair of drafting rolls and the take-up device, a measuring value receiver connected with the regulation means, said measuring value receiver generating signals proportional to the drive speed of the supply device and the measuring roll driven thereby, said signals being delivered to the regulation means as an additional guide magnitude and processed therein for regulating the drive speed of the pair of drafting rolls and the take-up device, a monitoring device cooperating with the regulation means and arranged between the pair of drafting rolls and the take-up device for monitoring the through-hang of the loop of the fiber sliver, said monitoring device comprising an upper trigger location responsive to a minimum through-hang of the fiber sliver loop and a lower trigger location responsive to the maximum through-hang of the fiber sliver loop, said regulation means processing signals generated at each trigger location for the additional regulation of the drive speed of the take-up device in such a manner that upon response of the upper trigger location the drive speed of the take-up device is reduced for such length of time until the lower trigger location responds, whereafter the drive speed of the take-up device is increased for such length of time until the upper trigger location again response, and stop means operatively connected to the sliver supply device to stop said supply device when the drafting magnitude of the regulation drafting arrangement assumes a value falling outside of a fixed range.

2. The apparatus as defined in claim 1, wherein the measuring rolls are structured as a pair of grooved rolls.

3. The apparatus as defined in claim 1, wherein the monitoring device comprises two light barriers arranged in spaced relationship from one another, each light barrier defining a respective one of the trigger locations.

4. The apparatus as defined in claim 1, wherein the monitoring device comprises two capacitive elements arranged in spaced relationship from one another and each defining one of said trigger locations, each of said capacitive elements responding when there occurs a change in its capacitance as a result of the through-passge of the sliver loop.

5. The apparatus as defined in claim 1, wherein the monitoring device comprises two terminal switches, each of the terminal switches defining one of the trigger locations, said terminal switches being activated by a member displaceable by the sliver loop.

6. The apparatus as defined in claim 1, further including an indicator device for indicating the thickness of the fiber sliver.

7. An apparatus for producing a uniform textile fiber sliver, comprising:

a sliver supply device for delivering a fiber sliver;
a take-up device for the fiber sliver;
means including a drive motor for driving said take-up device independently of said supply device;
a regulation drafting arrangement for the fiber sliver located between said supply device and said take-up device, including a pair of measuring rolls and a pair of driven drafting rolls, one of said pair of measuring rolls being driven and the other roll being deflectable as a function of the change in thickness of the fiber sliver guided between said measuring rolls;
means including a driving motor for independently driving said pair of drafting rolls;
means for driving said driven measuring rolls of said pair of measuring rolls in cooperative relationship with said supply device;
a measuring value receiver for sensing the deflection of said other measuring roll and for providing a signal indicative of the deflection;
a second measuring value receiver for sensing the drive speed of said supply device and for generating signals proportional to such drive speed;
a monitoring device arranged between said pair of drafting rolls and said take-up device for monitoring the through-hang of a loop of the fiber sliver, said monitoring device comprising an upper trigger location responsive to a minimum through-hang of the fiber sliver loop for producing a signal indicative of the minimum through-hang, and a lower trigger location responsive to the maximum through-hang of the fiber sliver loop for producing a signal indicative of the maximum through-hand; and
regulation means for regulating the drive speed of said pair of drafting rolls and the driving speed of said take-up device as a function of the deflection of said other measuring roll and for the additional regulation of the drive speed of said take-up device as a function of the length of the fiber sliver between said pair of drafting rolls and said take-up device, said regulation means including:
a speed regulator connected to said drive motor for said pair of drafting rolls for regulating the rotational speed of said drafting rolls drive motor;
a second speed regulator connected to said drive motor for said take-up device for regulating the rotational speed of said take-up device motor; and
a computer having an input connected to and for receiving signals from said measuring value receiver, said second measuring value receiver and said monitoring device, and an output connected to said speed and said second speed regulators,
said regulation means processing signals generated at each of said trigger locations and providing an output control signal for the additional regulation of the drive speed of said take-up device in such a manner that upon response of said upper trigger location the drive speed of said take-up device is reduced for such length of time until said lower trigger location responds, whereafter the drive speed of said take-up device is increased for such length of time until said upper trigger location again responds.

8. The apparatus as defined in claim 7, wherein the drive motors of the take-up device and the pair of drafting rolls comprise direct-current motors and the speed regulators comprise thyristor regulators with phase control.

9. The apparatus as defined in claim 7, wherein the computer comprises a multiplier having an input side and output means, said output means being connected with the speed regulators, a reference value transmitter for preselecting a desired thickness of the fiber sliver, a divider having an output, the input side of the multiplier being connected with said second measuring value receiver and with the output of the divider, the divider having an input side receiving input signals from said measuring value receiver and from said reference value transmitter.

10. The apparatus as defined in claim 9, further including an indicator device for indicating the thickness of the fiber sliver, the indicator device being connected with the output of the divider.

11. An apparatus for producing a uniform textile fiber sliver, comprising:
a sliver supply device for delivering a fiber sliver;
a take-up device for the fiber sliver;
means including a drive motor for driving said take-up device independently or said supply device;
a regulation drafting arrangement for the fiber sliver located between said supply device and said take-up device, including a pair of measuring rolls and a pair of driven drafting rolls, one of said pair of measuring rolls being driven and the other measuring roll being deflectable as a function of the change in thickness of the fiber sliver guided between said measuring rolls;
means including a driving motor for independently driving said pair of drafting rolls;
means for driving said driven measuring rolls of said pair of measuring rolls in cooperative relationship with said supply device;
a measuring value receiver for sensing the deflection of said other measuring roll and for providing a signal indicative of the deflection;
a second measuring value receiver for sensing the drive speed of said supply device and for generating signals proportional to such drive speed;
a monitoring device arranged between said pair of drafting rolls and said take-up device for monitoring the through-hang of a loop of the fiber sliver, said monitoring device comprising an upper trigger location responsive to a minimum through-hang of the fiber sliver loop for producing a signal indicative of the minimum through-hang, and a lower trigger location responsive to the maximum through-hang of the fiber sliver loop for producing a signal indicative of the maximum through-hang; and
regulation means for regulating the drive speed of said pair of drafting rolls and the driving speed of said take-up device as a function of the deflection of said other measuring roll and for the additional regulation of the drive speed of said take-up device as a function of the length of the fiber sliver between said pair of drafting rolls and said take-up device, said regulation means including:
a speed regulator connected to said drive motor for said pair of drafting rolls for regulating the rotational speed of said drafting rolls drive motor;
a second speed regular connected to said drive motor for said take-up device for regulating the rotational speed of said take-up device motor, said second speed regulator being connected to said monitoring device; and a computer having an input connected to and for receiving signals from said measuring value receiver and said second measuring value receiver and providing an output control signal to said speed and said second speed regulators, said second speed regulator being controlled by signals from said computer and said monitoring device to regulate the drive speed of said take-up device in such a manner that upon response of said upper trigger location the drive speed of said take-up device is reduced for such length of time until said lower trigger location responds, whereafter the drive speed of said take-up device is increased for such length of time until said upper trigger location again responds.

12. The apparatus as defined in claim 11, wherein the drive motors of the take-up device and the pair of drafting rolls comprise direct-current motors and the speed regulators comprise thyristor regulators with phase control.

13. The apparatus as defined in claim 11, wherein the computer comprises a multiplier having an input side and output means, said output means being connected with said speed and said second speed regulators, a reference value transmitter for preselecting a desired thickness of the fiber sliver, a divider having an output, the input side of the multiplier being connected with said second measuring value receiver and with the output of the divider, the divider having an input side receiving input signals from said measuring value receiver and from said reference value transmitter .

14. The apparatus as defined in claim 13, further including an indicator device for indicating the thickness of the fiber sliver, the indicator device being connected with the output of the divider.

* * * * *